US007425524B2

(12) United States Patent
Haire et al.

(10) Patent No.: US 7,425,524 B2
(45) Date of Patent: Sep. 16, 2008

(54) GEAR LUBRICANT WITH A BASE OIL HAVING A LOW TRACTION COEFFICIENT

(75) Inventors: Michael J. Haire, Petaluma, CA (US); John A. Zakarian, Hercules, CA (US); John M. Rosenbaum, Richmond, CA (US); Nancy J. Bertrand, Lafayette, CA (US); Stephen J. Miller, San Francisco, CA (US); Trevor Miller, Alameda, CA (US); Vivek Palekar, Pleasanton, CA (US); Ajit Ramchandra Pradhan, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 63 days.

(21) Appl. No.: 11/400,570

(22) Filed: Apr. 7, 2006

(65) Prior Publication Data

US 2007/0238628 A1 Oct. 11, 2007

(51) Int. Cl.
*C10M 169/04* (2006.01)
*C10G 71/00* (2006.01)
*C07C 27/00* (2006.01)

(52) U.S. Cl. ..... 508/110; 208/18; 518/706; 508/591

(58) Field of Classification Search ..... 508/110, 508/591; 208/18; 518/706
See application file for complete search history.

(56) References Cited

U.S. PATENT DOCUMENTS 7,045,055 B2 * 5/2006 Ziemer et al. ..... 208/18
7,053,254 B2 * 5/2006 Miller ..... 585/1
7,195,706 B2 * 3/2007 Abernathy et al. ..... 208/18
2005/0098476 A1 5/2005 Miller
2005/0133407 A1 6/2005 Abernathy et al.
2005/0241990 A1 11/2005 Ziemer et al.
2005/0258078 A1 11/2005 Rosenbaum et al.
2005/0261145 A1 11/2005 Rosenbaum et al.
2005/0261146 A1 11/2005 Rosenbaum et al.
2005/0261147 A1 11/2005 Rosenbaum et al.

FOREIGN PATENT DOCUMENTS

WO WO 2004/053030 A2 6/2004

OTHER PUBLICATIONS

U.S. Appl. No. 60/599,665, filed Aug. 5, 2004, entitled "Multigrade Engine Oil Prepared From Fischer-Tropsch Distillate Base Oil" 38 pages.
U.S. Appl. No. 10/949,779, filed Sep. 23, 2004, entitled "Multigrade Engine Oil Prepared From Fischer-Tropsch Distillate Base Oil" 39 pages.
U.S. Appl. No. 11/296,639 filed Dec. 7, 2005, entitled "Manual Transmission Fluid Made With Lubricating Base Oil Multicyclooparaffins" 31 pages.

* cited by examiner

*Primary Examiner*—Glenn Caldarola
*Assistant Examiner*—Jim Goloboy
(74) *Attorney, Agent, or Firm*—Susan M. Abernathy

(57) ABSTRACT

A multigrade automotive gear lubricant comprising a base oil having a traction coefficient less than 0.021. A method for saving energy using a gear lubricant, comprising blending a multigrade gear lubricant by adding a base oil having a traction coefficient less than 0.021, and using the gear lubricant in an axle or differential. A process for making an energy saving automotive gear lubricant having a kinematic viscosity at 100° C. greater than 10 cSt. A gear lubricant comprising a FT derived base oil having a VI greater than 150 and a traction coefficient less than 0.015. A finished lubricant, comprising a FT derived base oil having a traction coefficient less than 0.015. A base oil having a traction coefficient less than 0.011 and a 50 wt % boiling point greater than 582° C.

46 Claims, No Drawings

GEAR LUBRICANT WITH A BASE OIL HAVING A LOW TRACTION COEFFICIENT

FIELD OF THE INVENTION

This invention is directed to lubricant base oils, and finished lubricants made from them, having very low traction coefficients.

BACKGROUND OF THE INVENTION

Others have made gear lubricants having low ratios of Brookfield viscosity to kinematic viscosity at 100° C. using polyalphaolefins, or combinations of petroleum derived base oils with significant levels of viscosity index improver. For example, Chevron Tegra® Synthetic Gear Lubricant SAE 80W-140 is made with highly refined petroleum derived Group III base oil and greater than 20 wt % viscosity index improver. Chevron Tegra® Synthetic Gear Lubricant SAE 75W-90 is made with polyalphaolefin and diester base oils. Tegra®°is a registered trademark of Chevron Corporation. Polyalphaolefin base oils are expensive and have less desired elastomer compatibility than other base oils. Diester base oil provides improved elastomer compatibility and additive solubility, but is also very expensive and available in limited quantities.

European Patent Application No. 1570035A2 teaches that functional fluids may be made using base oils having low CCS viscosity, wherein the functional fluids also have low Brookfield viscosity. Nothing is taught regarding selection of base oils having more a desired molecular composition or low traction coefficients.

Commonly assigned U.S. Patent Application Publication No. 20050133407 discloses that gear lubricants may be made having a low Brookfield viscosity from a Fischer-Tropsch derived lubricating base oil having a desired molecular composition. Commonly assigned U.S. patent application Ser. No. 11/296,636, filed Dec. 7, 2005, discloses that base oils with high VI and having low aromatics and preferred high levels of predominantly molecules with monocycloparaffinic functionality can be used to blend manual transmission fluids with very high VIs and low Brookfield viscosities at −40° C. Commonly assigned U.S. Patent Application Publication Nos. 20050258078, 20050261145, 20050261146, and 20050261147 disclose that blends of base oils made from highly paraffinic wax with Group II or Group III base oils will have very low Brookfield viscosities. Commonly assigned U.S. Patent Application Publication No. 20050241990 discloses that wormgear lubricants may be made using base oils having a low traction coefficient made from a waxy feed. Commonly assigned U.S. Patent Application Publication No. 20050098476 discloses pour point depressing base oil blending components made by hydroisomerization dewaxing a waxy feed and selection of a heavy distillation bottoms product. Commonly assigned U.S. Provisional Patent Application 60/599,665, filed Aug. 5, 2004 and U.S. patent application Ser. No. 10/949,779, filed Sep. 23, 2004, discloses that multigrade engine oil blends of Fischer-Tropsch derived distillate products and a pour point depressing base oil blending component prepared from an isomerized bottoms product may be made having low Brookfield viscosities.

A gear lubricant is desired having a higher kinematic viscosity at 100° C. and lower Brookfield Ratio than the gear lubricants previously made. Preferably, the gear lubricant will have a kinematic viscosity greater than 10 cSt at 100° C., and will also have a low Brookfield viscosity relative to kinematic viscosity; and a process to make it is also desired.

Preferably, the gear lubricant will also not require high amounts of viscosity index improver.

A lubricant base oil having a very low traction coefficient, and finished lubricants including gear lubricants made from the base oil, are also highly desired.

SUMMARY OF THE INVENTION

We have invented a multigrade automotive gear lubricant, comprising:

a. between 5 and 95 wt % of a base oil, made from a waxy feed, having a traction coefficient less than 0.021 when measured at a kinematic viscosity of 15 cSt and at a slide to roll ratio of 40%;
b. less than 2 wt % viscosity index improver or other thickener; and
c. an EP gear lubricant additive.

We have also invented a method for saving energy using a gear lubricant, comprising:

a. blending a multigrade gear lubricant by adding between 5 to 95 wt %, based on the total gear lubricant, of a lubricating base oil having a traction coefficient less than 0.021 when measured at a kinematic viscosity of 15 cSt and a slide to roll ratio of 40%; and
b. using the gear lubricant in an axle or differential.

We have also invented a process for making an energy saving automotive gear lubricant, comprising:

a. hydroisomerizing a waxy feed in an isomerization zone in the presence of a hydroisomerization catalyst and hydrogen under pre-selected conditions determined to provide a hydroisomerized base oil product;
b. distilling the hydroisomerized base oil product recovered from the isomerization zone under distillation conditions pre-selected to collect an energy saving base oil product characterized by having a traction coefficient less than 0.021 when measured at 15 cSt and at a slide to roll ratio of 40%;
c. blending the energy saving base oil product with an EP gear lubricant additive to make the energy saving gear lubricant; wherein the energy saving gear lubricant has a kinematic viscosity at 100° C. greater than 10 cSt.

We have invented a gear lubricant comprising a Fischer-Tropsch derived base oil having a VI greater than 150 and a traction coefficient less than 0.015 when measured at a kinematic viscosity of 15 cSt and at a slide to roll ratio of 40%.

We have also invented a finished lubricant, comprising:

a. a Fischer-Tropsch derived base oil having a traction coefficient less than 0.015 when measured at 15 cSt and at a slide to roll ratio of 40%; and
b. an effective amount of one or more lubricant additives.

We have also invented a lubricant base oil, comprising a. a traction coefficient less than 0.011; and
b. a 50 weight percent boiling point by ASTM D 6352 greater than 582° C. (1080° F).

DETAILED DESCRIPTION OF THE INVENTION

SAE J306 defines the different viscosity grades of automotive gear lubricants. A multigrade automotive gear lubricant refers to an automotive gear lubricant that has viscosity/temperature characteristics which fall within the limits of two different SAE numbers in SAE J306, June 1998. For example, an SAE 75W-90 automotive gear lubricant has a maximum temperature of −40° C. for a viscosity of 150,000 cP and a kinematic viscosity at 100° C. between 13.5 and less than 24.0 cSt. The second SAE viscosity grade, XX, for a multigrade automotive gear lubricant is always a higher number than the proceeding "W" SAE viscosity grade; thus you may have an 80W-90 multigrade automotive gear lubricant but not an 80W-80 multigrade automotive gear lubricant.

Automotive Gear Lubricant Viscosity Classifications - SAE J306, June 1998

| SAE Viscosity Grade | Max Temperature for Viscosity of 150,000 cP (° C.) | Kinematic Viscosity at 100° C. (cSt) min | max |
|---|---|---|---|
| 70W | −55 | 4.1 | — |
| 75W | −40 | 4.1 | — |
| 80W | −26 | 7.0 | — |
| 85W | −12 | 11.0 | — |
| 80 | — | 7.0 | <11.0 |
| 85 | — | 11.0 | <13.5 |
| 90 | — | 13.5 | <24.0 |
| 140 | — | 24.0 | <41.0 |
| 250 | — | 41.0 | |

Examples of automotive gear lubricants are manual transmission fluids, axle lubricants and differential fluids.

The Maximum Temperature for Viscosity of 150,000 cP (° C.) is measured by scanning Brookfield Viscosity by ASTM D 2983-04. Gear lubricants having a low Brookfield viscosity, especially those with a low Brookfield Ratio are especially desired. A low Brookfield Ratio is associated with improved low temperature properties of the gear lubricant.

The Brookfield Ratio is calculated by the following equation:

Brookfield Ratio=Brookfield Viscosity in cP, measured at Temperature β in ° C., divided by the Kinematic Viscosity at 100° C. in cSt.

Temperature β=−40° C. when the gear lubricant is an SAE 75W-XX.

Temperature β=−26° C. when the gear lubricant is an SAE 80W-XX, and

Temperature β=−12° C. when the gear lubricant is an SAE 85W-XX.

The Brookfield Ratio of the gear lubricant of this invention is less than an amount calculated based on the Temperature β by the following equation:

$$613 \times e^{(-0.07 \times \beta)};$$

where β=−40 when the gear lubricant is an SAE 75W-XX, β=−26 when the gear lubricant is an SAE 80W-XX, and β=−12 when the gear lubricant is an SAE 85W-XX. Thus, for an SAE 75W-XX automotive gear lubricant of this invention, the Brookfield Ratio is less than 10081, preferably less than 8000; for an SAE 80W-XX automotive gear lubricant, the Brookfield Ratio is less than 3783.3, preferably less than 2500; and for an SAE 85W-XX automotive gear lubricant, the Brookfield Ratio is less than 1419.9. Note that XX in this invention refers to the SAE viscosity grades of 80, 85, 90, 140, or 250. The XX for an automotive gear lubricant will always be a higher number than the proceeding "W" SAE viscosity grade; thus you may have an 80W-90 gear lubricant but not a 80W-80 gear lubricant.

Note that the gear lubricants of this invention are a preferred subset of those meeting the SAE J306 specification. For example, an SAE 75W-90 oil with a Brookfield viscosity at the maximum of 150,000 cP divided by a typical kinematic viscosity at 100° C. of 14 cSt would have a Brookfield Ratio of 10714, which would not be as desired as the lubricants of this invention with a lower Brookfield Ratio.

The gear lubricants of this invention have a higher kinematic viscosity at 100° C. than other oils made from a waxy feed having low Brookfield viscosities. The gear lubricants of this invention have a kinematic viscosity at 100° C. greater than 10 cSt. Preferably they have a kinematic viscosity at 100° C. less than or equal to 41.0 cSt. In one embodiment, they have a kinematic viscosity at 100° C. greater than 13 cSt; and in another embodiment, they have a kinematic viscosity at 100° C. greater than 20 cSt. In preferred embodiments, the gear lubricants of this invention comprise greater than 12 wt %, more preferably greater than 15 wt %, most preferably greater than 25 wt % of a base oil having:

i. a sequential number of carbon atoms,
ii. less than 0.06 wt % aromatics,
iii. greater than 20 wt % total molecules with cycloparaffinic functionality, and
iv. a ratio of molecules with monocycloparaffinic functionality to molecules with multicycloparaffinic functionality greater than 12.

The terms "Fischer-Tropsch derived" or "FT derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

"Waxy feed" is a feed or stream comprising hydrocarbon molecules with a carbon number of C20+ and having a boiling point generally above about 600° F. (316° C.). The waxy feeds useful in the processes disclosed herein may be synthetic waxy feedstocks, such as Fischer-Tropsch waxy hydrocarbons, or may be derived from natural sources. Accordingly, the waxy feeds to the processes may comprise Fischer-Tropsch derived waxy feeds, petroleum waxes, waxy distillate stocks such as gas oils, lubricant oil stocks, high pour point polyalphaolefins, foots oils, normal alpha olefin waxes, slack waxes, deoiled waxes, and microcrystalline waxes, and mixtures thereof. Preferably, the waxy feedstocks are derived from Fischer-Tropsch waxy feeds.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes possess a very high viscosity index, normally in the range of from about 140 to 200, depending on the oil content and the starting material from which the slack wax was prepared. Therefore, slack waxes are suitable for the preparation of base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into base oil. Accordingly, Fischer-Tropsch wax represents an excellent feed for preparing high quality base oils according to the process of the invention. Fischer-Tropsch wax is normally solid at room temperature and, consequently, displays poor low temperature properties, such as pour point and cloud point. However, following hydroisomerization of the wax, Fischer-Tropsch derived base oils having excellent low temperature properties may be prepared. A general description of suitable hydroisomerization dewaxing processes may be found in U.S. Pat. Nos. 5,135,638 and 5,282,958; and U.S. Patent Application Publication No. 20050133409, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably, the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the base oil. Preferred hydroisomerizing conditions useful in the current invention include temperatures of 260° C. to about 413° C. (500 to about 775° F.), a total pressure of 15 to 3000 psig, and a hydrogen to feed ratio from about 0.5 to 30 MSCF/bbl, preferably from about 1 to about 10 MSCF/bbl, more preferably from about 4 to about 8 MSCF/bbl. Generally, hydrogen will be separated from the product and recycled to the isomerization zone.

Optionally, the base oil produced by hydroisomerization dewaxing may be hydrofinished. The hydrofinishing may occur in one or more steps, either before or after fractionating of the base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the base oil to less than 10, preferably less than 5, more preferably less than 1, and most preferably less than 0.5. The hydrofinishing step may also be needed to reduce the weight percent aromatics to less than 0.1, preferably less than 0.06, more preferably less than 0.02, and most preferably less than 0.01.

The base oil is fractionated into different viscosity grades of base oil. In the context of this disclosure "different viscosity grades of base oil" is defined as two or more base oils differing in kinematic viscosity at 100° C. from each other by at least 1.0 cSt. Kinematic viscosity is measured using ASTM D 445-04. Fractionating is done using a vacuum distillation unit to yield cuts with pre-selected boiling ranges.

The base oil fractions will typically have a pour point less than 0° C. Preferably, the pour point will be less than −10° C. Additionally, in some embodiments the pour point of the base oil fraction will have a ratio of pour point, in ° C., to the kinematic viscosity at 100° C., in cSt, greater than a Base Oil Pour Factor, where the Base Oil Pour Factor is defined by the equation:

$$\text{Base Oil Pour Factor} = 7.35 \times \text{Ln}(\text{Kinematic Viscosity at } 100^\circ\text{ C.}) - 18$$

Pour point is measured by ASTM D 5950-02.

The base oil fractions have measurable quantities of unsaturated molecules measured by FIMS. In a preferred embodiment, the hydroisomerization dewaxing and fractionating conditions in the process of this invention are tailored to produce one or more selected fractions of base oil having greater than 10 wt % total molecules with cycloparaffinic functionality, preferably greater than 20, greater than 35, or greater than 40; and a viscosity index greater than 150. The one or more selected fractions of base oils will usually have less than 70 wt % total molecules with cycloparaffinic functionality. Preferably, the one or more selected fractions of base oil will additionally have a ratio of molecules with monocycloparaffinic functionality to molecules with multicycloparaffinic functionality greater than 2.1. In preferred embodiments, the base oil has a ratio of molecules with monocycloparaffinic functionality to molecules with multicycloparaffinic functionality greater than 5, or greater than 12. In preferred embodiments, the base oil may contain no molecules with multicycloparaffinic functionality, such that the ratio of molecules with monocycloparaffinic functionality to molecules with multicycloparaffinic functionality is greater than 100.

In some preferred embodiments, the lubricant base oil fractions useful in this invention have a viscosity index greater than an amount defined by the equation:

$$\text{VI} = 28 \times \text{Ln}(\text{Kinematic Viscosity at } 100^\circ\text{ C.}) + 95$$

In other preferred embodiments, lubricant base oil fractions useful in this invention have a viscosity index greater than an amount defined by the equation:

$$\text{VI} = 28 \times \text{Ln}(\text{Kinematic Viscosity at } 100^\circ\text{ C.}) + 105$$

The presence of predominantly cycloparaffinic molecules with monocycloparaffinic functionality in the base oil fractions of this invention provides excellent oxidation stability, low Noack volatility, as well as desired additive solubility and elastomer compatibility. The base oil fractions have a weight percent olefins less than 10, preferably less than 5, more preferably less than 1, and most preferably less than 0.5. The base oil fractions preferably have a weight percent aromatics less than 0.1, more preferably less than 0.05, and most preferably less than 0.02.

In preferred embodiments, the base oil fractions have a traction coefficient less than 0.023, preferably less than or equal to 0.021, more preferably less than or equal to 0.019, when measured at a kinematic viscosity of 15 cSt and at a slide to roll ratio of 40%. Preferably, they have a traction coefficient less than an amount defined by the equation:

$$\text{traction coefficient} = 0.009 \times \text{Ln}(\text{Kinematic Viscosity}) - 0.001$$

wherein the Kinematic Viscosity during the traction coefficient measurement is between 2 and 50 cSt; and wherein the traction coefficient is measured at an average rolling speed of 3 meters per second, a slide to roll ratio of 40%, and a load of 20 Newtons. Examples of these preferred base oil fractions are taught in U.S. Patent Application Publication No. 20050241990 A1, filed Apr. 29, 2004. The gear lubricants made using the preferred base oil having a low traction coefficient will save energy and operate cooler.

In more preferred embodiments, the base oil fractions having a low traction coefficient also have large film thicknesses. That is they have an EHD film thickness greater than 175 nanometers when measured at a kinematic viscosity of 15 cSt. The preferred base oils of this invention have film thicknesses about the same or thicker than PAOs, but have lower traction coefficients than PAOs.

In some of the most preferred embodiments, the base oil fractions have a traction coefficient less than 0.017, or even less than 0.015, or less than 0.011, when measured at 15 cSt and at a slide to roll ratio of 40 percent The base oil fractions having the lowest traction coefficients have unique branching properties by NMR, including a branching index less than or equal to 23.4, a branching proximity greater than or equal to 22.0, and a Free Carbon Index between 9 and 30. Additionally they preferably have greater than 4 wt % naphthenic carbon, more preferably greater than 5 wt % naphthenic carbon by ndM analysis by ASTM D 3238. The base oil fractions having the lowest traction coefficients generally have a pour point less than −15° C., but surprisingly may have a ratio of pour point, in degrees C., to the kinematic viscosity at 100 degrees C., in cSt, less than an amount defined by the equation: Base Oil Pour Factor=7.35×Ln(Kinematic Viscosity at 100° C.)−18. The base oil fractions having the lowest traction coefficients have a higher kinematic viscosity and higher boiling points. Preferably the lubricant base oil fractions having a traction coefficient less than 0.015 have a 50 weight percent boiling point greater than 566° C. (1050° F.). In one embodiment the lubricant base oil fraction of the invention has a traction coefficient less than 0.011 and a 50 weight percent boiling point by ASTM D 6352 greater than 582° C. (1080° F).

The lubricant base oil fractions useful in this invention, unlike polyalphaolefins (PAOs) and many other synthetic lubricating base oils, contain hydrocarbon molecules having consecutive numbers of carbon atoms. This is readily determined by gas chromatography, where the lubricant base oil fractions boil over a broad boiling range and do not have sharp peaks separated by more than 1 carbon number. In other words, the lubricating base oil fractions have chromatographic peaks at each carbon number across their boiling range.

The Oxidator BN of the lubricant base oil fraction most useful in the invention is greater than 10 hours, preferably greater than 12 hours, In preferred embodiments, where the olefin and aromatics contents are significantly low in the lubricant base oil fraction of the lubricating oil, the Oxidator BN of the selected base oil fraction will be greater than 25 hours, preferably greater than 35 hours, more preferably greater than 40 or even 41 hours. The Oxidator BN of the selected base oil fraction will typically be less than 60 hours. Oxidator BN is a convenient way to measure the oxidation stability of base oils. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows:

Copper=6,927 ppm;
Iron=4,083 ppm;
Lead=80,208 ppm;
Manganese=350 ppm;
Tin=3565 ppm.

The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability.

OLOA is an acronym for Oronite Lubricating Oil Additive®, which is a registered trademark of Chevron Oronite.

Lubricant Additive

The finished lubricant of the present invention comprises an effective amount of one or more lubricant additives. Lubricant additives which may be blended with the lubricating base oil to form the finished lubricant composition include those which are intended to improve certain properties of the finished lubricant. Typical lubricant additives include, for example, anti-wear additives, EP agents, detergents, dispersants, antioxidants, pour point depressants, Viscosity Index improvers, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and the like. Typically, the total amount of one or more lubricant additives in the finished lubricant is within the range of 0.1 to 30 wt %. Typically, the amount of lubricating base oil of this invention in the finished lubricant is between 10 and 99.9 wt %, preferably between 25 and 99 wt %. Lubricant additive suppliers will provide information on effective amounts of their individual lubricant additives or additive packages to be blended with lubricating base oils to make finished lubricants. However due to the excellent properties of the lubricating base oils of the invention, less additives than required with lubricating base oils made by other processes may be required to meet the specifications for the finished lubricant.

Viscosity Index Improvers (VI Improvers)

VI improvers modify the viscometric characteristics of lubricants by reducing the rate of thinning with increasing temperature and the rate of thickening with low temperatures. VI improvers thereby provide enhanced performance at low and high temperatures. VI improvers are typically subjected to mechanical degradation due to shearing of the molecules in high stress areas. High pressures generated in hydraulic systems subject fluids to shear rates up to $10^7$ $s^{-1}$. Hydraulic shear causes fluid temperature to rise in a hydraulic system and shear may bring about permanent viscosity loss in lubricating oils.

Generally, VI improvers are oil soluble organic polymers, typically olefin homo- or co-polymers or derivatives thereof, of number average molecular weight of about 15000 to 1 million atomic mass units (amu). VI improvers are generally added to lubricating oils at concentrations from about 0.1 to 10 wt %. They function by thickening the lubricating oil to which they are added more at high temperatures than low, thus keeping the viscosity change of the lubricant with temperature more constant than would otherwise be the case. The change in viscosity with temperature is commonly represented by the viscosity index (VI), with the viscosity of oils with large VI (e.g., 140) changing less with temperature than the viscosity of oils with low VI (e.g., 90).

Major classes of VI improvers include: polymers and copolymers of methacrylate and acrylate esters; ethylene-propylene copolymers; styrene-diene copolymers; and polyisobutylene, VI improvers are often hydrogenated to remove residual olefin. VI improver derivatives include dispersant VI improver, which contain polar functionalities such as grafted succinimide groups.

The gear lubricant of the invention has less than 10 wt % VI improver, preferably less than 5 wt % VI improver. In certain embodiments, the gear lubricant may contain very low levels of VI improver, such as less than 2 wt % or less than 0.5 wt %, preferably less than 0.4%, more preferably less than 0.2 wt % of VI improver. The gear lubricant may even contain no VI improver.

Thickeners

Thickeners, in the context of this disclosure are oil soluble or oil miscible hydrocarbons with a kinematic viscosity at 100° C. greater than 100 cSt. Examples of thickeners are polyisobutylene, high molecular weight complex ester, butyl rubber, olefin copolymers, styrene-diene polymer, polymethacrylate, styrene-ester, and ultra high viscosity PAO. Preferably, the thickener has a kinematic viscosity at 10° C. of about 150 cSt to about 10,000 cSt.

In one embodiment, the gear lubricant of the invention has less than 2 wt % thickener.

Base Oil Distillation

The separation of Fischer-Tropsch derived fractions and petroleum derived fractions into various fractions having characteristic boiling ranges is generally accomplished by either atmospheric or vacuum distillation or by a combination of atmospheric and vacuum distillation. As used in this disclosure, the term "distillate fraction" or "distillate" refers to a side stream fraction recovered either from an atmospheric fractionation column or from a vacuum column as opposed to the "bottoms" which represents the residual higher boiling fraction recovered from the bottom of the column. Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures, thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Pour Point Depressant

The gear lubricants of the present invention further comprise at least one pour point depressant. They contain from about 0.01 to 12 wt % based upon the total lubricant blend of a pour point depressant. Pour point depressants are known in the art and include, but are not limited to esters of maleic anhydride-styrene copolymers, polymethacrylates, polyacrylates, polyacrylamides, condensation products of haloparaffin waxes and aromatic compounds, vinyl carboxylate polymers, and terpolymers of dialkylfumarates, vinyl esters of fatty acids, ethylene-vinyl acetate copolymers, alkyl phenol formaldehyde condensation resins, alkyl vinyl ethers, olefin copolymers, and mixtures thereof. Preferably, the pour point depressant is polymethacrylate.

The pour point depressant utilized in the present invention may also be a pour point depressing base oil blending component prepared from an isomerized Fischer-Tropsch derived bottoms product, as described in U.S. Patent Application Publication No. 20050098476, the contents of which is herein incorporated by reference in its entirety. When used, the pour point depressing base oil blending component reduces the pour point of the lubricant blend at least 3° C. below the pour point of the lubricant blend in the absence of the pour point depressing base oil blending component. The pour point depressing base oil blending component is an isomerized Fischer-Tropsch derived bottoms product having a pour point that is at least 3° C. higher than the pour point of the lubricant blend comprising the lubricant base oil fraction derived from highly paraffinic wax and the petroleum derived base oil (i.e., the blend in the absence of a pour point depressant). For example, if the target pour point of the lubricant blend is −9° C. and the pour point of the lubricant blend in the absence of pour point depressant is greater than −9° C., an amount of the pour point depressing base oil blending component of the invention will be blended with the lubricant blend in sufficient proportion to lower the pour point of the blend to the target value.

The isomerized Fischer-Tropsch derived bottoms product used to lower the pour point of the lubricant blend is usually recovered as the bottoms from the vacuum column of a Fischer-Tropsch operation. The average molecular weight of the pour point depressing base oil blending component usually will fall within the range of from about 600 to about 1100 with an average molecular weight between about 700 and about 1000 being preferred. Typically, the pour point of the pour point depressing base oil blending component will be between about −9° C. and about 20° C. The 10% point of the boiling range of the pour point depressing base oil blending component usually will be within the range of from about 850° F. and about 1050° F. Preferably, the pour point depressing base oil blending component will have an average degree of branching in the molecules between about 6.5 and about 10 alkyl branches per 100 carbon atoms.

In one embodiment, the lubricant blend may comprise a pour point depressant well known in the art and a pour point depressing base oil blending component. The pour point depressing base oil blending component may be an isomerized Fischer-Tropsch derived bottoms product or an isomerized petroleum derived bottoms product. Pour points depressing base oil blending components that are isomerized petroleum derived bottoms product are described in U.S. Patent Application Publication No. 20050247600. In such an embodiment, preferably the lubricant blend comprises 0.05 to 15 wt % (more preferably 0.5 to 10 wt %) pour point depressing base oil blending component that is isomerized Fischer-Tropsch derived, or petroleum derived, bottoms product.

Bright stock is a high viscosity base oil which is named for the SUS viscosity at 210° F. Typically petroleum derived bright stock will have a viscosity above 180 cSt at 40° C., preferably above 250 cSt at 40° C., and more preferably ranging from 500 to 1100 cSt at 40° C. Bright stock derived from Daqing crude has been found to be especially suitable for use as the pour point depressing base oil blending component of the present invention. The bright stock should be hydroisomerized and may optionally be solvent dewaxed. Bright stock prepared solely by solvent dewaxing has been found to be much less effective as a pour point depressing base oil blending component.

EP Gear Lubricant Additive

The gear lubricants of this invention comprise between 2 and 35 wt %, preferably between 2.5 and 30 wt %, more preferably between 2.5 and 20 wt %, of an extreme pressure (EP) gear lubricant additive. EP gear lubricant additives are added to lubricants to prevent destructive metal-to-metal contact in the lubrication of moving surfaces. While under normal conditions termed "hydrodynamic", a film of lubricant is maintained between the relatively moving surfaces governed by lubricant parameters, and principally viscosity. However, when load is increased, clearance between the surfaces is reduced, or when speeds of moving surfaces are such that the film of oil cannot be maintained, the condition of "boundary lubrication" is reached; governed largely by the parameters of the contacting surfaces. At still more severe conditions, significant destructive contact manifests itself in various forms such as wear and metal fatigue as measured by ridging and pitting. It is the role of EP gear lubricant additive to prevent this from happening. For the most part, EP gear lubricant additives have been oil soluble or easily dispersed as a stable dispersion in the oil, and largely have been organic compounds chemically reacted to contain sulfur, halogen (principally chlorine), phosphorous, carboxyl, or carboxylate salt groups which react with the metal surface under boundary lubrication conditions. Stable dispersions of hydrated alkali metal borates have also been found to be effective as EP gear lubricant additives.

Moreover, because hydrated alkali metal borates are insoluble in lubricant oil media, it is necessary to incorporate the borate as a dispersion in the oil and homogenous dispersions are particularly desirable. The degree of formation of a homogenous dispersion can be correlated to the turbidity of the oil after addition of the hydrated alkali metal borate with higher turbidity correlating to less homogenous dispersions. In order to facilitate formation of such a homogenous dispersion, it is conventional to include a dispersant in such compositions. Examples of dispersants include lipophilic surface-active agents such as alkenyl succinimides or other nitrogen containing dispersants as well as alkenyl succinates. It is also conventional to employ the alkali metal borate at particle sizes of less than 1 micron in order to facilitate the formation of the homogenous dispersion. A preferred EP gear lubricant additive of this invention comprises an oil dispersion of hexagonal boron nitride.

Other preferred EP gear lubricant additives of this invention comprise a dispersed hydrated potassium borate or dispersed hydrated sodium borate composition having a specific degree of dehydration. The dispersed hydrated potassium borate compositions are described in U.S. Pat. No. 6,737,387. Preferably, in this embodiment, the dispersed hydrated potassium borate is characterized by a hydroxyl:boron ratio (OH:B) of from at least 1.2:1 to 2.2:1, and a potassium to boron ratio of from about 1:2.75 to 1:3.25. The dispersed hydrated sodium borate compositions are described in U.S. Pat. No. 6,634,450. Preferably in this embodiment, the dispersed hydrated sodium borate is characterized by a hydroxyl:boron ratio (OH:B) of from about 0.80:1 to 1.60:1, and a sodium to boron ratio of from about 1:2.75 to 1:3.25.

In another embodiment, the preferred EP gear lubricant additive of this invention comprises a combination of three components, which are (1) hydrated alkali metal borates; (2) at least one dihydrocarbyl polysulfide component comprising a mixture including no more than 70 wt. % dihydrocarbyl trisulfide, more than 5.5 wt. % dihydrocarbyl disulfide, and at least 30 wt. % dihydrocarbyl tetrasulfide or higher polysulfides; and (3) a non-acidic phosphorus component comprising a trihydrocarbyl phosphite component, at least 90 wt. % of which has the formula $(RO)_3P$, where R is alkyl of 4 to 24 carbon atoms and at least one dihydrocarbyl dithiophosphate derivative. The preferred alkali metal borate compositions where the ratio of polysulfides is carefully controlled are described in U.S. patent application Ser. No. 11/122,461, filed on May 4, 2005. These preferred EP gear lubricant additives with the combination described above have superior load carrying properties and improved storage stability.

The EP gear lubricant additive is typically combined with other additives in a gear lubricant additive package. A variety of other additives can be present in the gear lubricants of the present invention. These additives include antioxidants, viscosity index improvers, dispersants, rust inhibitors, foam inhibitors, corrosion inhibitors, other antiwear agents, demulsifiers, friction modifiers, pour point depressants and a variety of other well-known additives. Preferred dispersants include the well known succinimide and ethoxylated alkylphenols and alcohols. Particularly preferred additional additives are the oil-soluble succinimides and oil-soluble alkali or alkaline earth metal sulfonates.

The gear lubricant of this invention may also comprise other base oils, such as for example Group I, Group II, petroleum derived Group III, or synthetic base oils such as polyalphaolefins, esters, polyglycols, polyisobutenes, and alkylated naphthalenes.

The Pour Point Depressing Base Oil Blending Component

Some embodiments of the gear lubricants of this invention comprise a pour point depressing base oil blending component. The pour point depressing base oil blending component is usually prepared from the high boiling bottoms fraction remaining in the vacuum tower after distilling off the lower boiling base oil fractions. It will have a molecular weight of at least 600. It may be prepared from either a Fischer-Tropsch derived bottoms or a petroleum derived bottoms. The bottoms is hydroisomerized to achieve an average degree of branching in the molecule between about 5 and about 9 alkyl-branches per 100 carbon atoms. Following hydroisomerization the pour point depressing base oil blending component should have a pour point between about −20° C. and about 20° C., usually between about −10° C. and about 20° C. The molecular weight and degree of branching in the molecules are particularly critical to the proper practice of the invention.

In the case of Fischer-Tropsch syncrude, the pour point depressing base oil blending component is prepared from the waxy fraction that is normally a solid at room temperature. The waxy fraction may be produced directly from the Fischer-Tropsch syncrude or it may be prepared from the oligomerization of lower boiling Fischer-Tropsch derived olefins. Regardless of the source of the Fischer-Tropsch wax, it must contain hydrocarbons boiling above about 950° F. in order to produce the bottoms used in preparing the pour point depressing base oil blending component. In order to improve the pour point and VI, the wax is hydroisomerized to introduce favorable branching into the molecules. The hydroisomerized wax will usually be sent to a vacuum column where the various distillate base oil cuts are collected. In the case of Fischer-Tropsch derived base oil, these distillate base oil fractions may be used for the hydroisomerized Fischer-Tropsch distillate base oil. The bottoms material collected from the vacuum column comprises a mixture of high boiling hydrocarbons which are used to prepare the pour depressing base oil blending component. In addition to hydroisomerization and fractionation, the waxy fraction may undergo various other operations, such as, for example, hydrocracking, hydrotreating, and hydrofinishing. The pour point depressing base oil blending component of the present invention is not an additive in the normal use of this term within the art, since it is really only a high boiling base oil fraction.

The pour point depressing base oil blending component will have a pour point that is at least 3° C. higher than the pour point of the hydroisomerized Fischer-Tropsch distillate base oil. It has been found that when the hydroisomerized bottoms as described in this disclosure is used to reduce the pour point of the blend, the pour point of the blend will be below the pour point of both the pour point depressing base oil blending component and the hydroisomerized distillate Fischer-Tropsch base oil. Therefore, it is not necessary to reduce the pour point of the bottoms to the target pour point of the engine oil.

Accordingly, the actual degree of hydroisomerization need not be as high as might otherwise be expected, and the hydroisomerization reactor may be operated at lower severity with less cracking and less yield loss. It has been found that the bottoms should not be over hydroisomerized or its ability to act as a pour point depressing base oil blending component will be compromised. Accordingly, the average degree of branching in the molecules of the Fischer-Tropsch bottoms should fall within the range of from about 5 to about 9 alkyl branches per 100 carbon atoms.

A pour point depressing base oil blending component derived from a Fischer-Tropsch feedstock will have an average molecular weight between about 600 and about 1,100, preferably between about 700 and about 1,000. The kinematic viscosity at 100° C. will usually fall within the range of from about 8 cSt to about 22 cSt. The 10% boiling point of the boiling range of the bottoms typically will fall between about 850° F. and about 1050° F. Generally, the higher molecular weight hydrocarbons are more effective as pour point depressing base oil blending components than the lower molecular weight hydrocarbons. Typically, the molecular weight of the pour point depressing base oil blending component will be 600 or greater. Consequently, higher cut points in the fractionation column which result in a higher boiling bottoms material are usually preferred when preparing the pour point depressing base oil blending component. The higher cut point also has the advantage of producing a higher yield of the distillate base oil fractions.

It has also been found that by solvent dewaxing the hydroisomerized bottoms product at a low temperature, generally −10° C. or less, the effectiveness of the pour point depressing base oil blending component may be enhanced. The waxy product separated during solvent dewaxing from the bottoms has been found to display improved pour point depressing properties provided the branching properties remain within the limits of the invention. The oily product recovered after the solvent dewaxing operation while displaying some pour point depressing properties is less effective than the waxy product.

In the case of being petroleum-derived, the basic method of preparation is essentially the same as already described above. Particularly preferred for preparing a petroleum derived pour point depressing base oil blending component is bright stock containing a high wax content. Bright stock constitutes a bottoms fraction which has been highly refined and dewaxed. Bright stock is a high viscosity base oil which is named for the SUS viscosity at 210° F. Typically petroleum derived bright stock will have a viscosity above 180 cSt at 40° C., preferably above 250 cSt at 40° C., and more preferably ranging from 500 to 1100 cSt at 40° C. Bright stock derived from Daqing crude has been found to be especially suitable for use as the pour point depressing base oil blending component of the present invention. The bright stock should be hydroisomerized and may optionally be solvent dewaxed. Bright stock prepared solely by solvent dewaxing has been found to be much less effective as a pour point depressing base oil blending component.

The petroleum derived pour point depressing base oil blending component preferably will have a paraffin content of at least about 30 wt %, more preferably at least 40 wt %, and most preferably at least 50 wt %. The boiling range of the pour point depressing base oil blending component should be above about 950° F. (510° C.). The 10% boiling point should be greater than about 1050° F. (565° C.) with a 10% point in excess of 1150° F. (620° C.) being preferred. The average degree of branching in the molecules of the petroleum derived pour point depressing base oil blending component preferably will fall within the range of from about 5 to about 9 alkyl-branches per 100 carbon atoms, more preferably from about 6 to about 8 alkyl-branches per 100 carbon atoms.

Specific Analytical Test Methods

Brookfield viscosities were measured by ASTM D 2983-04. Pour points were measured by ASTM D 5950-02.

Wt % Olefins

The Wt % Olefins in the base oils of this invention is determined by proton-NMR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30° pulse is applied, the instrument must have a minimum signal digitization dynamic range of 65,000. Preferably the dynamic range will be 260,000 or more.

C. Measure the integral intensities between:

6.0-4.5 ppm (olefin)

2.2-1.9 ppm (allylic)

1.9-0.5 ppm (saturate)

D. Using the molecular weight of the test substance determined by ASTM D 2503, calculate:

1. The average molecular formula of the saturated hydrocarbons.
2. The average molecular formula of the olefins.
3. The total integral intensity (=sum of all integral intensities).
4. The integral intensity per sample hydrogen (=total integral/number of hydrogens in formula).
5. The number of olefin hydrogens (=Olefin integral/integral per hydrogen).
6. The number of double bonds (=Olefin hydrogen times hydrogens in olefin formula/2).
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the percent olefins result is low, less than about 15 wt %. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV

The method used to measure low levels of molecules with at least one aromatic function in the lubricant base oils of this invention uses a Hewlett Packard 1050 Series Quaternary Gradient High Performance Liquid Chromatography (HPLC) system coupled with a HP 1050 Diode-Array UV-V is detector interfaced to an HP Chem-station. Identification of the individual aromatic classes in the highly saturated Base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution. Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified. Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Molecular Composition by FIMS

The lubricant base oils of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the base oil to be tested in a glass capillary tube. The capillary tube was placed at the tip of a solids probe for a mass spectrometer, and the probe was heated from about 40 to 50° C. up to 500 or 600° C. at a rate between 50° C. and 100° C. per minute in a mass spectrometer operating at about $10^{-6}$ torr. The mass spectrometer was scanned from m/z 40 to m/z 1000 at a rate of 5 seconds per decade.

The mass spectrometer used was a Micromass Time-of-Flight. Response factors for all compound types were assumed to be 1.0, such that weight percent was determined from area percent. The acquired mass spectra were summed to generate one "averaged" spectrum.

The lubricant base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricant base oil they would be identified in the FIMS analysis as 4-unsaturations. When olefins were present in significant amounts in the lubricant base oil they would be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality in the lubricant base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl) naphthalene, and the like.

Molecules with monocycloparaffinic functionality mean any molecule that is a monocyclic saturated hydrocarbon group of 3 to 7 ring carbons or any molecule that is substituted with a single monocyclic saturated hydrocarbon group of 3 to 7 ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of 3 to 7 ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

NMR Branching Properties

The branching properties of the base oils of the present invention was determined by analyzing a sample of oil using carbon-13 ($^{13}C$) NMR according to the following ten-step process. References cited in the description of the process provide details of the process steps. Steps 1 and 2 are performed only on the initial materials from a new process.

1) Identify the CH branch centers and the $CH_3$ branch termination points using the DEPT Pulse sequence (Doddrell, D. T.; Pegg, D. T.; Bendall, M. R., *Journal of Magnetic Resonance* 1982, 48, 323ff.).
2) Verify the absence of carbons initiating multiple branches (quaternary carbons) using the APT pulse sequence (Patt, S. L.; Shoolery, J. N., *Journal of Magnetic Resonance* 1982, 46, 535ff.).
3) Assign the various branch carbon resonances to specific branch positions and lengths using tabulated and calculated values (Lindeman, L. P., *Journal of Qualitative Analytical Chemistry* 43, 1971 1245ff; Netzel, D. A., et. al., *Fuel*, 60, 1981, 307ff).

Examples

| Branch | NMR Chemical Shift (ppm) |
|---|---|
| 2-methyl | 22.7 |
| 3-methyl | 19.3 or 11.4 |
| 4-methyl | 14.3 |
| 4 + methyl | 19.8 |
| Internal ethyl | 10.8 |
| Internal propyl | 14.5 or 20.5 |
| Adjacent methyls | 16.5 |

4) Estimate relative branching density at different carbon positions by comparing the integrated intensity of the specific carbon of the methyl/alkyl group to the intensity of a single carbon (which is equal to total integral/number of carbons per molecule in the mixture). For the unique case of the 2-methyl branch, where both the terminal and the branch methyl occur at the same resonance position, the intensity was divided by two before estimating the branching density. If the 4-methyl branch fraction is calculated and tabulated, its contribution to the 4+methyls must be subtracted to avoid double counting.
5) Calculate the average carbon number. The average carbon number may be determined with sufficient accuracy for lubricant materials by dividing the molecular weight of the sample by 14 (the formula weight of $CH_2$).
6) The number of branches per molecule is the sum of the branches found in step 4.
7) The number of alkyl branches per 100 carbon atoms is calculated from the number of branches per molecule (step 6) times 100/average carbon number.
8) Estimate Branching Index (BI). The BI is estimated by $^{1}H$ NMR Analysis and presented as percentage of methyl hydrogen (chemical shift range 0.6-1.05 ppm) among total hydrogen as estimated by NMR in the liquid hydrocarbon composition.
9) Estimate Branching proximity (BP). The BP is estimated by $^{13}C$ NMR and presented as percentage of recurring methylene carbons which are four or more carbons away from the end group or a branch (represented by a NMR signal at 29.9 ppm) among total carbons as estimated by NMR in the liquid hydrocarbon composition.
10) Calculate the Free Carbon Index (FCI). The FCI is expressed in units of carbons. Counting the terminal methyl or branch carbon as "one" the carbons in the FCI are the fifth or greater carbons from either a straight chain terminal methyl or from a branch methine carbon. These carbons appear between 29.9 ppm and 29.6 ppm in the carbon-13 spectrum. They are measured as follows:

a. calculate the average carbon number of the molecules in the sample as in step 5, b. divide the total carbon-13 integral area (chart divisions or area counts) by the average carbon number from step a. to obtain the integral area per carbon in the sample, c. measure the area between 29.9 ppm and 29.6 ppm in the sample, and d. divide by the integral area per carbon from step b. to obtain FCI (EP1062306A1).

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width for the $^{13}C$ NMR studies was limited to the saturated carbon region, about 0-80 ppm vs. TMS (tetramethylsilane). Solutions of 25-50% by weight in chloroform-dl were excited by 30° pulses followed by a 1.3 second acquisition time. In order to minimize non-uniform intensity data, the broadband proton inverse-gated decoupling was used during a 6 second delay prior to the excitation pulse and on during acquisition. Samples were also doped with 0.03 to 0.05 M $Cr(acac)_3$ (tris(acetylacetonato)-chromium(III)) as a relaxation agent to ensure full intensities are observed. Total experiment times ranged from 4 to 8 hours. The $^{1}H$ NMR analysis were also carried out using a spectrometer having a magnet of 7.0 T or greater. Free induction decay of 64 coaveraged transients were acquired, employing a 90° excitation pulse, a relaxation decay of 4 seconds, and acquisition time of 1.2 seconds.

The DEPT and APT sequences were carried out according to literature descriptions with minor deviations described in the Varian or Bruker operating manuals. DEPT is Distortionless Enhancement by Polarization Transfer. The DEPT 45 sequence gives a signal all carbons bonded to protons. DEPT 90 shows CH carbons only. DEPT 135 shows CH and $CH_3$ up and $CH_2$ 180° out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyl group are clearly identified by chemical shift and phase. Both are described in the references cited.

The branching properties of each sample were determined by $^{13}C$ NMR using the assumption in the calculations that the entire sample was iso-paraffinic. Corrections were not made for n-paraffins or naphthenes, which may have been present in the oil samples in varying amounts. The naphthenes content may be measured using Field Ionization Mass Spectroscopy (FIMS).

"Alkyl" means a linear saturated monovalent hydrocarbon radical of 1 to 6 carbon atoms or a branched saturated monovalent hydrocarbon radical of 3 to 8 carbon atoms. Preferably, the alkyl branches are methyl. Examples of alkyl branches include, but are not limited to, groups such as methyl, ethyl, n-propyl, isopropyl, n-butyl, isobutyl, sec-butyl, t-butyl, n-pentyl, and the like.

EXAMPLES

The following examples are included to further clarify the invention but are not to be construed as limitations on the scope of the invention.

Example 1

A hydrotreated cobalt based Fischer-Tropsch wax had the following properties:

TABLE I

| Properties | |
|---|---|
| Nitrogen, ppm | <0.2 |
| Sulfur, ppm | <6 |
| n-paraffin b GC, wt % | 76.01 |

A base oil, FT-7.3, was made from the hydrotreated cobalt based Fischer-Tropsch wax by hydroisomerization dewaxing, hydrofinishing, fractionating, and blending to a viscosity target. The base oil had the properties as shown in Table II.

TABLE II

| CVX Sample ID<br>Sample Properties | FT-7.3 |
|---|---|
| Viscosity at 100° C., cSt | 7.336 |
| Viscosity Index | 165 |
| Pour Point, ° C. | −20 |
| ASTM D 6352 SIMDIST (wt %), ° F. | |
| 5 | 742 |
| 10/30 | 777/858 |
| 50 | 906 |
| 70/90 | 950/995 |
| 95 | 1011 |
| 1-Ring | 0.02312 |
| 2-Ring | 0.00446 |
| 3-Ring | 0.00028 |
| 4-Ring | 0.00032 |
| 6-Ring | 0.00001 |
| Total Wt % Aromatics | 0.02819 |
| Wt % Olefins | 4.45 |
| FIMS, Wt % | |
| Alkanes | 72.8 |
| 1-Unsaturations | 27.2 |
| 2- to 6-Unsaturations | 0.0 |
| Total | 100.0 |
| Total wt % Molecules with Cycloparaffinic Functionality | 27.2 |
| Ratio of Monocycloparaffins to Multicycloparaffins | >100 |
| Oxidator BN, hours | 24.08 |
| X in the equation: VI = 28 × Ln(VIS100) + X | 109 |
| Traction Coefficient at 15 cSt | <0.021 |

Example 2

Three blends of gear lubricant using the FT-7.3 were blended with gear lubricant EP antiwear additive packages. The gear lubricant additive packages comprised sulfur phosphorus (S/P) and a stable dispersion of hydrated alkali metal borate EP additives, combined with other additives. The additives used in GEARA and GEARB were the same as those used in commercial production of Chevron Delo® Gear Lubricants ESI®. The additives used in GEARC were the same as those used in commercial production of Chevron Delo® Trans Fluid ESI®. Delo® and ESI® are registered trademarks of Chevron Corporation. The formulations of these three gear lubricant blends are summarized in Table III.

TABLE III

| Component, Wt % | GEARA | GEARB | GEARC |
|---|---|---|---|
| S/P & Borate EP Additive | 6.50 | 6.50 | 4.80 |
| FT-7.3 | 49.75 | 11.61 | 40.35 |
| Citgo Bright Stock 150 | 43.25 | 81.29 | 53.29 |
| PMA Pour Point Depressant | 0.40 | 0.30 | 0.80 |
| Corrosion Inhibitor | 0.08 | 0.04 | 0.60 |
| Antifoam Agent | 0.02 | 0.02 | 0.01 |
| Dispersant/Detergent | 0.00 | 0.24 | 0.00 |
| Antioxidant | 0.00 | 0.00 | 0.15 |
| Total | 100.00 | 100.00 | 100.00 |
| Total Wt % of gear lubricant having: <0.06 wt % aromatics, >20 wt % total molecules with cycloparaffinic functionality, and a ratio of molecules with monocycloparaffinic functionality to molecules with multicycloparaffinic functionality > 12. | 49.75 | 11.61 | 40.35 |

Citgo Bright Stock 150 is a petroleum derived Group I bright stock produced by solvent dewaxing.

The properties of these three different gear lubricant blends are shown in Table IV.

TABLE IV

| Properties | GEARA | GEARB | GEARC |
|---|---|---|---|
| SAE Viscosity Grade | 80W-90 | 85W-140 | 80W-90 |
| Viscosity at 100° C. cSt | 14.44 | 25.32 | 14.51 |
| Brookfield Viscosity, cP, @ −26° C. | 31750 | | 36250 |
| Brookfield Viscosity, cP, @ −12° C. | | 35650 | |
| Foam | | | |
| Seq I | 0/0 | 0/0 | 0/0 |
| Seq II | 0/0 | 0/0 | 10/0 |
| Seq III | 0/0 | 0/0 | 0/0 |
| Cu Strip Corrosion @ 100° C. for 3 Hours | 2A | 2C | 1B |
| Storage Stability Rating after 20 Weeks at Room Temperature, Liq/Sediment | 2/0 | 2/0 | 2/0 |
| Storage Stability after 20 Weeks at 66° C., Liquid/Sediment | 2/2 | 2/0 | 2/1 |
| β, ° C. | −26 | −12 | −26 |
| Brookfield Ratio | 2199 | 1408 | 2498 |
| $613 \times e^{(-0.07\times\beta)}$ | 3783.3 | 1419.9 | 3783.3 |

GEARA and GEARB are excellent gear lubricants for all types of automotive and industrial bearings and gears. They are suitable for top-off of limited slip differentials. They meet the requirements for the 750,000-mile extended warranty program in Dana/Spicer axles. GEARA also meets the requirements for extended service in Meritor axles for 500,000 mile oil drains. GEARC is ideally suited for heavy duty manual transmissions. GEARC meets the requirements for Eaton's 750,000-mile extended warranty program for transmission fluids.

GEARA, GEARB, and GEARC are examples of the gear lubricants of this invention with very low Brookfield viscosities relative to their kinematic viscosities. All three of them have a Brookfield Ratio (ratio of Brookfield Viscosity at β, in ° C., divided by the kinematic viscosity at 100° C.) less than or equal to an amount defined by the equation:

$$\text{Brookfield Ratio}=613\times e^{(-0.07\times\beta)}$$

Their low ratios were surprising considering that they contained significant amounts of Citgo Bright Stock 150 and no viscosity index improver. Additionally all three of these oils showed good storage stability, low foaming, and good copper strip corrosion results. Surprisingly, no viscosity index improver was used in any of these examples.

GEARA and GEARC both had more than 12 wt % of the base oil, based on the weight of the total gear lubricant, having the more desired properties of:

a) less than 0.06 wt % aromatics, b) greater than 20 wt % total molecules with cycloparaffinic functionality, and c) a ratio of molecules with monocycloparaffinic functionality to molecules with multicycloparaffinic functionality greater than 12.

These examples would have had even better properties if they had been blended with a base oil having less than 0.5 wt % olefins; and with a bright stock that is also a pour point reducing blending component.

Example 3

Three comparative blends were made using conventional Group II base oils, using the same gear lubricant additive packages as the blends described in Example 2. The formulations of these comparison blends are summarized in Table V.

TABLE V

| Component, Wt % | Comp. GEARD | Comp. GEARE | Comp. GEARF |
|---|---|---|---|
| SAE Grade | 80W-90 | 85W-140 | 80W-90 |
| S/P & Borate EP Additive | 6.50 | 6.50 | 4.80 |
| Chevron 600R | 78.18 | 16.74 | 75.71 |
| Citgo Bright Stock 150 | 14.82 | 76.16 | 17.93 |
| PMA PPD | 0.40 | 0.30 | 0.80 |
| Corrosion Inhibitor | 0.08 | 0.04 | 0.60 |
| Antifoam Agent | 0.02 | 0.02 | 0.01 |
| Dispersant/Detergent | 0.00 | 0.24 | 0.00 |
| Antioxidant | 0.00 | 0.00 | 0.15 |
| Total | 100.00 | 100.00 | 100.00 |
| Total Wt % of gear lubricant having: <0.06 wt % aromatics, >20 wt % total molecules with cycloparaffinic functionality, and a ratio of molecules with monocycloparaffinic functionality to molecules with multicycloparaffinic functionality > 12. | 0 | 0 | 0 |

Note that Citgo Bright Stock 150 is a Group I base oil having greater than 25 wt % aromatics and a VI less than 100.

The properties of these three different comparative gear lubricant blends are shown in Table VI.

TABLE VI

| Properties | Comp. GEARD | Comp. GEARE | Comp. GEARF |
|---|---|---|---|
| SAE Grade | 80W-90 | 85W-140 | 80W-90 |
| Viscosity at 100° C. cSt | 14.23 | 24.92 | 14.53 |
| Brookfield Viscosity, cP, @ −26° C. | 65100 | | 77500 |
| Brookfield Viscosity, cP, @ −12° C. | | 35500 | |
| Foam | | | |
| Seq I | 0/0 | 0/0 | 0/0 |
| Seq II | 0/0 | 0/0 | 35/0 |

TABLE VI-continued

| Properties | Comp. GEARD | Comp. GEARE | Comp. GEARF |
|---|---|---|---|
| Seq III | 0/0 | 0/0 | 0/0 |
| Cu Strip Corrosion @ 100° C. for 3 Hours | 1B | 2C | 1B |
| Storage Stability Rating after 20 Weeks at Room Temperature, Liq/Sediment | 2/0 | 2/0 | 2/0 |
| Storage Stability after 20 Weeks at 66° C., Liquid/Sediment | 2/1 | 2/2 | 4/1 |
| β, ° C. | −26 | −12 | −26 |
| Brookfield Ratio | 4575 | 1425 | 5334 |
| $613 \times e^{(-0.07\times\beta)}$ | 3783.3 | 1419.9 | 3783.3 |

These comparative blends made using different base oils did not have the desired low Brookfield viscosity relative to the kinematic viscosity of the gear lubricants of this invention. All of them had a Brookfield Ratio (ratio of Brookfield Viscosity at β, in ° C., divided by the kinematic viscosity at 100° C.) greater than an amount defined by the equation:

$$\text{Brookfield Ratio}=613\times e^{(-0.07\times\beta)}$$

None of them contained any of the preferred base oil with:

a) less than 0.06 wt % aromatics, b) greater than 20 wt % total molecules with cycloparaffinic functionality, and c) a ratio of molecules with monocycloparaffinic functionality to molecules with multicycloparaffinic functionality greater than 12.

Example 4

Five base oils, FT-4.1 FT-4.3, FT-7.9, FT-8.0 and FT-16, were made from the same FT wax described in Example 1. The processes used to make the base oils were hydroisomerization dewaxing, hydrofinishing, fractionating, and blending to a viscosity target. FT-16 was a vacuum distillation bottoms product. Hydrofinishing was done to a greater extent with these base oils, such that the olefins were effectively eliminated. A sixth base oil, FT-24, was made from a hydrotreated Co-based FT wax having less than 0.2 ppm nitrogen, less than 6 ppm sulfur and a wt % of n-paraffin by GC of 76.01. The FT-24 base oil was made by hydroisomerization dewaxing, hydrofinishing, fractionating, and selection of a heavy bottoms product having a kinematic viscosity at 100° C. greater than 20 cSt and a T10 boiling point greater than 1000° F. The six different base oils had the properties as shown in Table VII

TABLE VII

| Sample Properties | FT-4.1 | FT-4.3 | FT-7.9 | FT-8 | FT-16 | FT-24 |
|---|---|---|---|---|---|---|
| Viscosity at 100° C., cSt | 4.102 | 4.271 | 7.932 | 7.969 | 16.24 | 24.25 |
| Viscosity Index | 146 | 147 | 162 | 162 | 161 | 158 |
| Pour Point, ° C. | −24 | −22 | −20 | −22 | −10 | 0 |
| ASTM D 6352 SIMDIST (wt %), ° F. | | | | | | |
| 5 | 733 | 749 | 868 | 863 | 963 | 1080 |
| 10/30 | 754/791 | 763/795 | 883/916 | 882/921 | 991/1044 | 1090/1121 |
| 50 | 820 | 822 | 940 | 945 | 1081 | 1153 |
| 70/90 | 852/888 | 852/886 | 971/1005 | 978/1010 | 1122/1193 | 1193/1266 |
| 95 | 899 | 896 | 1021 | 1034 | 1230 | 1299 |
| Total Wt % Aromatics | 0.01903 | 0.00283 | 0.01548 | 0.00598 | 0.0325 | <0.06 |
| Wt % Olefins | 0.00 | 0.00 | 0.00 | 0.00 | 0.00 | 4.96 |
| Wt % Naphthenic Carbon by ASTM D3238 | 4.72 | 5.34 | 5.80 | 6.92 | 6.81 | 5.3 |
| FIMS, Wt % | | | | | | Not tested |
| Alkanes | 78.7 | 79.5 | 68.3 | 68.2 | 63.1 | |
| 1-Unsaturations | 19.8 | 19.2 | 28.2 | 29.3 | 35.6 | |
| 2- to 6-Unsaturations | 1.5 | 1.3 | 3.5 | 2.5 | 1.3 | |
| Total | 100.0 | 100.0 | 100.0 | 100.0 | 100.0 | |
| Total Molecules with Cycloparaffinic Functionality | 21.3 | 20.5 | 31.7 | 31.8 | 36.9 | Not tested |
| Ratio of Monocycloparaffins to Multicycloparaffins | 13.2 | 14.8 | 8.1 | 11.7 | 27.4 | Not tested |
| Oxidator BN, Hours | 37.2 | 37.1 | 43.1 | 46.8 | 46.1 | 16.72 |
| X in the equation: VI = 28 × Ln(VIS100) + X | 106 | 106 | 104 | 104 | 83 | 69 |
| Alkyl-branches per 100 carbon atoms, by NMR | 9.14 | 9.31 | 8.31 | 8.52 | 7.62 | 6.83 |
| Traction Coefficient at 15 cSt | <0.023 | <0.023 | 0.0167 | <0.023 | 0.0113 | 0.0098 |
| NMR Branching Analysis | | | | | | |
| Branching Index | 26.46 | 26.46 | 23.64 | 23.42 | 20.28 | 18.97 |
| Branching Proximity | 17.87 | 18.83 | 22.79 | 22.64 | 27.15 | 29.39 |
| Free Carbon Index | 5.32 | 5.84 | 9.08 | 8.88 | 15.09 | 20.34 |

FT-4.1, FT-4.3, FT-16, and FT-24 are base oils having:

a) less than 0.06 wt % aromatics, b) greater than 20 wt % total molecules with cycloparaffinic functionality, and c) a ratio of molecules with monocycloparaffinic functionality to molecules with multicycloparaffinic functionality greater than 12 FT-7.9 and FT-8, although having high VI and total weight percent molecules with cycloparaffinic functionality, did not have a ratio of molecules with monocycloparaffinic functionality to molecules with multicycloparaffinic functionality greater than 12. FT-16 and FT-24 are also pour point depressing base oil blending components prepared from an isomerized Fischer-Tropsch derived bottoms product. FT-4.1, FT-4.3 and FT-7.9 had pour points such that the ratio of pour point, in ° C., to the kinematic viscosity at 100° C., in cSt, was greater than a Base Oil Pour Factor, where the Base Oil Pour Factor is defined by the equation:

$$\text{Base Oil Pour Factor} = 7.35 \times \text{Ln}(\text{Kinematic Viscosity at } 100^\circ\text{ C.}) - 18$$

All of these base oil fractions also had traction coefficients less than 0.023 when measured at 15 cSt and at a slide to roll ratio of 40%. Surprisingly, the FT-7.9, FT-16 and FT-24 base oils had traction coefficients less than 0.017. FT-24 had an especially low traction coefficient of less than 0.011. The lubricant base oils having a traction coefficient less than 0.021 are examples of base oils that would be especially useful in gear lubricants to save energy. Examples of gear lubricants where significant energy savings would be achieved are heavy duty gear lubricants, EP gear lubricants, and wormgear lubricants.

Example 5

Six blends of SAE75W-90 gear lubricant were blended with different combinations of the base oils described in Example 4. The formulations of these six gear lubricants are summarized in Table VII.

TABLE VII

| Component, Wt % | GEARG | GEARH | GEARJ | GEARK | GEARL | GEARM |
|---|---|---|---|---|---|---|
| SAE Grade | 75W-90 | 75W-90 | 75W-90 | 75W-90 | 75W-90 | 75W-90 |
| Gear Lubricant Additive Package with S/P EP Gear Additive | 50.0 | 50.0 | 50.0 | 50.0 | 50.0 | 50.0 |
| FT-4.1 | 0.0 | 0.0 | 0.0 | 35.0 | 31.5 | 30.0 |
| FT-4.3 | 34.8 | 36.3 | 37.8 | 0.0 | 0.0 | 0.0 |
| FT-7.9 | 0.0 | 0.0 | 0.0 | 15.0 | 18.5 | 20.0 |
| FT-8 | 15.3 | 12.3 | 9.3 | 0.0 | 0.0 | 0.0 |
| FT-16 | 0.0 | 1.5 | 3.0 | 0.0 | 0.0 | 0.0 |
| Total | 100.0 | 100.0 | 100.0 | 100.0 | 100.0 | 100.0 |
| Total Wt % of gear lubricant having: <0.06 wt % aromatics, >20 wt % total molecules with cycloparaffinic functionality, and a ratio of molecules with monocycloparaffinic functionality to molecules with multicycloparaffinic functionality > 12. | 34.8 | 37.8 | 40.8 | 35.0 | 31.5 | 30.0 |

The properties of these six different gear lubricant blends are shown in Table VIII.

TABLE VIII

| Property | GEARG | GEARH | GEARJ | GEARK | GEARL | GEARM |
|---|---|---|---|---|---|---|
| SAE Grade | 75W-90 | 75W-90 | 75W-90 | 75W-90 | 75W-90 | 75W-90 |
| Viscosity at 100° C., cSt | 14.87 | 14.88 | 14.84 | 14.28 | 14.68 | 14.82 |
| Viscosity Index | 156 | 156 | 156 | 158 | 157 | 157 |
| Brookfield Viscosity at −40° C., cP | 114200 | 112220 | 113000 | 103000 | 117800 | 128000 |
| Pour Point, ° C. | −47 | −44 | −45 | −47 | −45 | −44 |
| β, ° C. | −40 | −40 | −40 | −40 | −40 | −40 |
| Brookfield Ratio | 7680 | 7542 | 7615 | 7213 | 8025 | 8637 |
| $613 \times e(-0.07 \times \beta)$ | 10081 | 10081 | 10081 | 10081 | 10081 | 10081 |

Note that the oil that had the highest Brookfield Ratio (which is less desired) was GEARM. Of these samples, GEARM also had the lowest total weight percent of base oil having:

a) less than 0.06 wt % aromatics, b) greater than 20 wt % total molecules with cycloparaffinic functionality, and c) a ratio of molecules with monocycloparaffinic functionality to molecules with multicycloparaffinic functionality greater than 12. The blends additionally comprising a pour point depressing base oil blending component prepared from an isomerized Fischer-Tropsch derived bottoms product (GEARH and GEARJ) had lower Brookfield Ratios than GEARG which did not contain any.

Example 6

Two comparative blends of SAE 75W-90 gear lubricants were attempted to be made using the same base oils as used in Example 5. The formulations of these comparative gear lubricant blends are summarized in Table IX.

TABLE IX

| Component, Wt % | Comp. GEARN | Comp. GEARP |
|---|---|---|
| SAE Grade | 75W-90 | 75W-90 |
| Gear Lubricant Additive Package with S/P EP | 50.0 | 50.0 |
| Gear Lubricant Additive | | |
| FT-4.3 | 26.7 | 18.7 |
| FT-8 | 23.3 | 34.6 |
| Total | 100.0 | 100.0 |
| Total Wt % of gear lubricant having: <0.06 wt % aromatics, >20 wt % total molecules with cycloparaffinic functionality, and a ratio of molecules with monocycloparaffinic functionality to molecules with multicycloparaffinic functionality > 12. | 26.7 | 18.7 |

The properties of these two comparative gear lubricant blends are shown in Table X.

TABLE X

| Properties | Comp. GEARN | Comp. GEARP |
|---|---|---|
| Actual SAE Grade | 80W-90 | 80W-90 |
| Viscosity at 100° C., cSt | 15.69 | 15.36 |
| Viscosity Index | 155 | 156 |
| Brookfield Viscosity at −40° C., cP | 157000 | 164400 |
| Brookfield Viscosity at −26° C. cP | 12840 | 11620 |
| Pour Point, ° C. | −43 | −42 |
| β, ° C. | −26 | −26 |
| Brookfield Ratio | 818.4 | 756.5 |
| $613 \times e^{(-0.07\times\beta)}$ | 3783.3 | 3783.3 |

Because neither of these blends achieved a maximum of 150,000 cP at −40° C., they did not meet the specifications for 75W-90 gear lubricants. Instead, they were 80W-90 gear lubricants. Although both the comparative gear lubricants in Table X were made using the same base oils as the blends in Example 5, and had similar high viscosity indexes, they did not have the excellent low Brookfield Ratio of the preferred gear lubricants of this invention. Note that both of these comparative blends contained a higher amount of base oil (greater than 22 wt % of FT-8) having: a sequential number of carbon atoms, less than 40 wt % total molecules with cycloparaffinic functionality, and a ratio of molecules with monocycloparaffinic functionality to molecules with multicycloparaffinic functionality less than 12. FT-8 had a lower VI than some of the other base oils useful in this invention.

Example 7

A base oil was prepared by hydroisomerization dewaxing a 50/50 mix of Luxco 160 petroleum-based wax and Moore & Munger C80 Fe-based FT wax. The hydroisomerized product was hydrofinished and fractionated by vacuum distillation. A distillate fraction was selected having the properties described in Table XI.

TABLE XI

| Sample Properties | FT-7.6 |
|---|---|
| Viscosity at 100° C., cSt | 7.597 |
| Viscosity Index | 162 |
| Pour Point, ° C. | −13 |
| Total Wt % Aromatics | 0.0168 |
| Wt % Olefins | 0.0 |

TABLE XI-continued

| Sample Properties | FT-7.6 |
|---|---|
| FIMS, Wt % | |
| Alkanes | 58.3 |
| 1-Unsaturations | 34.4 |
| 2- to 6-Unsaturations | 7.3 |
| Total | 100.0 |
| Total wt % Molecules with Cycloparaffinic Functionality | 41.7 |
| Ratio of Monocycloparaffins to Multicycloparaffins | 4.7 |
| Oxidator BN, hours | 45.42 |
| X in the equation: VI = 28 × Ln(VIS100) + X | 105.2 |
| Traction Coefficient at 15 cSt | <0.021 |

FT-7.6 is an example of a base oil made from a waxy feed having a VI greater than an amount defined by the equation:

$$VI=28\times Ln(\text{Kinematic Viscosity at } 100^\circ \text{ C.})+105$$

It also has a very low traction coefficient.

Three different blends of multigrade automotive gear lubricant were blended with either the FT-7.6 detailed in example 7, or with PAO. The formulations of these three gear lubricants are summarized in Table XII.

TABLE XII

| Component, Wt % | Comp GEARQ | GEARR | GEART |
|---|---|---|---|
| SAE Grade | 75W-90 | 75W-90 | 75W-90 |
| Gear Lubricant Additive Package with Na-Borate EP Gear Additive | 7.96 | 7.96 | 7.96 |
| PAO - 6 cSt | 61.74 | 0 | 0 |
| PAO - 100 cSt | 30.30 | 24.06 | 0 |
| Citgo Bright Stock 150 | 0 | 0 | 52.05 |
| FT-7.6 | 0 | 67.98 | 39.99 |
| Total | 100.0 | 100.0 | 100.0 |

EHD film thickness data was obtained with an EHL Ultra Thin Film Measurement System from PCS Instruments, LTD. Measurements were made at 120° C., utilizing a polished 19 mm diameter ball (SAE AISI 52100 steel) freely rotating on a flat glass disk coated with transparent silica spacer layer [~500 nm thick] and semi-reflective chromium layer. The load on the ball/disk was 20N resulting in an estimated average contact stress of 0.333 GPa and a maximum contact stress of 0.500 GPa. The glass disk was rotated at 3 meters/sec at a slide to roll ratio of 0% with respect to the steel ball. Film thickness measurements were based on ultrathin film interferometry using white light. The optical film thickness values were converted to real film thickness values from the refractive indices of the oils as measured by a conventional Abbe refractometer at 120° C.

TABLE XIII

| Gear Lubricant Properties | Comp GEARQ | GEARR | GEART |
|---|---|---|---|
| Viscosity at 100° C., cSt | 14.26 | 14.27 | 14.24 |
| Viscosity Index | 157 | 160 | 122 |
| EHD Film Thickness, nm @ 120° C. and 3 m/s | 123.6 | 127.9 | 148.2 |

Note that the addition of the FT-7.6 base oil improved the film thickness of the automotive gear lubricants compared to the blend having only PAO.

Example 8

Three base oils that had low traction coefficients made according to the teachings in applicants' earlier patent applications are shown in Table XIV. FT-7.95 was disclosed in U.S. Patent Application Publication Nos. 20050133408 and 20050241990. FT-14 and FT-16 were disclosed in patent application Ser. No. 11/296,636, filed Dec. 7, 2005.

TABLE XIV

| Sample Properties | FT-7.95 | FT-14 | FT-16 |
|---|---|---|---|
| Viscosity at 100° C., cSt | 7.953 | 13.99 | 16.48 |
| Viscosity Index | 165 | 157 | 143 |
| Pour Point, ° C. | −12 | −8 | −16 |
| ASTM D 6352 SIMDIST (wt %), ° F. | | | |
| 50 | 919 | 1045 | 1072 |
| Total Wt % Aromatics | 0.0058 | 0.0414 | |
| Wt % Olefins | <0.5 | 3.17 | 0.12 |
| FIMS, Wt % | | | |
| 1-Unsaturations | >10 | 40.2 | 38.1 |
| 2- to 6-Unsaturations | <2 | 0.8 | 0.4 |
| Total Molecules with Cycloparaffinic Functionality | >10 | 37.83 | 38.4 |
| Ratio of Monocycloparaffins to Multicycloparaffins | >5 | 46.3 | 95 |
| Oxidator BN, Hours | Not tested | 18.89 | 42.9 |
| X in the equation: VI = 28 × Ln(VIS100) + X | 106.9 | 83 | 70.5 |
| Alkyl-branches per 100 carbon atoms, by NMR | 7.91 | 8.38 | 9.41 |
| Traction Coefficient at 15 cSt | 0.017 | 0.0135 | <0.021 |
| C13 NMR Branching | | | |
| Branching Index | 22.68 | 21.08 | 21.72 |
| Branching Proximity | 23.49 | 24.01 | 19.07 |

Note that neither FT-7.95, FT-14, nor FT-16 had the preferred combination of a traction coefficient less than 0.011 and a 50 wt % boiling point by ASTM D 6353 greater than 582° C. (1080° F.) of one of the embodiments of this invention.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A multigrade automotive gear lubricant, comprising:

a. between 5 and 95 wt % of a base oil, made from a waxy feed, having a traction coefficient less than 0.021 when measured at a kinematic viscosity of 15 cSt and at a slide to roll ratio of 40 percent;

b. less than 2 weight percent viscosity index improver or other thickener; and c. an EP gear lubricant additive.

2. The gear lubricant of claim 1, wherein the gear lubricant has:

i. a kinematic viscosity at 100° C. greater than 10 cSt, and ii. a ratio of Brookfield viscosity in cP, measured at temperature β in ° C. to the kinematic viscosity at 100° C. less than an amount defined by the equation: Brookfield Ratio=$613\times e^{(-0.07\times\beta)}$ and wherein β equals −40 when the gear lubricant is an SAE 75W-XX, β equals −26 when the gear lubricant is an SAE 80W-XX, and β equals −12 when the gear lubricant is an SAE 85W-XX.

3. The gear lubricant of claim 1, wherein the pour point of the base oil has a ratio of pour point, in degrees C., to the kinematic viscosity at 100 degrees C., in cSt, greater than a Base Oil Pour Factor, where the Base Oil Pour Factor is defined by the equation: Base Oil Pour Factor=7.35×Ln(Kinematic Viscosity at 100° C.)−18.

4. The gear lubricant of claim 2, wherein the kinematic viscosity at 100° C. is greater than 13 cSt.

5. The gear lubricant of claim 4, wherein the kinematic viscosity at 100° C. is greater than 20 cSt.

6. The gear lubricant of claim 1, wherein the gear lubricant has an EHD film thickness greater than 125 nanometers when measured at 120° C. and 3 meters/sec.

7. The gear lubricant of claim 1, wherein the gear lubricant is a transmission fluid, an axle lubricant, or a differential fluid.

8. The gear lubricant of claim 1, additionally comprising one or more additional base oils selected from the group of Group I, Group II, petroleum derived Group III, polyalphaolefin, ester, polyglycol, polyisobutene, and alkylated naphthalene.

9. The gear lubricant of claim 1, additionally comprising a pour point depressing base oil blending component prepared from an isomerized bottoms product having a pour point at least three degrees higher than a pour point of an isomerized distillate fraction also present in the gear lubricant.

10. The gear lubricant of claim 9, wherein the pour point depressing base oil blending component also has a traction coefficient less than 0.021 when measured at a kinematic viscosity of 15 cSt and at a slide to roll ratio of 40 percent.

11. The gear lubricant of claim 1, wherein the base oil, made from a waxy feed, has less than 0.5 wt % olefins.

12. The gear lubricant of claim 1, wherein the waxy feed is Fischer-Tropsch derived.

13. A method for saving energy using a gear lubricant, comprising:

a. blending a multigrade gear lubricant by adding between 5 to 95 weight percent, based on the total gear lubricant, of a lubricating base oil having a traction coefficient less than 0.021 when measured at a kinematic viscosity of 15 cSt and a slide to roll ratio of 40 percent; and b. using the gear lubricant in an axle or differential.

14. The method of claim 13, wherein the gear lubricant has a kinematic viscosity at 100° C. greater than 10 cSt.

15. The method of claim 13, wherein the gear lubricant has an EHD film thickness greater than 125 nanometers when measured at 120° C. and 3 meters/sec.

16. The method of claim 13, wherein the lubricating base oil is made from a waxy feed.

17. The method of claim 16, wherein the waxy feed is Fischer-Tropsch derived.

18. The method of claim 13, wherein the lubricating base oil has a ratio of pour point) in degrees C., to a kinematic viscosity at 100 degrees C., in cSt, greater than a Base Oil Pour Factor, where the Base Oil Pour Factor is defined by the equation: Base Oil Pour Factor=7.35×Ln(Kinematic Viscosity at 100° C.) 18.

19. The method of claim 13, additionally including blending the gear lubricant by additionally adding between 0.5 and 15 weight percent of the total gear lubricant of a pour point depressing base oil blending component made from an isomerized bottoms product.

20. The method of claim 13, additionally including blending the gear lubricant by additionally adding less than 10 weight percent of the total gear lubricant of a viscosity index improver.

21. The method of claim 13 wherein the traction coefficient is less than 0.017.

22. A process for making an energy saving automotive gear lubricant, comprising:

a. hydroisomerizing a waxy feed in an isomerization zone in the presence of a hydroisomerization catalyst and hydrogen under pre-selected conditions determined to provide a hydroisomerized base oil product;

b. distilling the hydroisomerized base oil product recovered from the isomerization zone under distillation conditions pre-selected to collect an energy saving base oil product characterized by having a traction coefficient less than 0.021 when measured at 15 cSt and at a slide to roll ratio of 40 percent;

c. blending the energy saving base oil product with an EP gear lubricant additive to make the energy saving gear lubricant; wherein the energy saving gear lubricant has a kinematic viscosity at 100° C. greater than 10 cSt.

23. The process of claim 22, wherein the waxy feed is Fischer-Tropsch derived.

24. The process of claim 22, additionally including blending the energy saving base oil product with less than 2 wt %, based on the total energy saving automotive gear lubricant, of a viscosity index improver.

25. The process of claim 22, wherein the traction coefficient is less than 0.017.

26. The process of claim 22, wherein the energy saving base oil product is a distillation bottoms product.

27. A gear lubricant comprising a Fischer-Tropsch derived base oil having a VI greater than 150 and a traction coefficient less than 0.015 when measured at a kinematic viscosity of 15 cSt and at a slide to roll ratio of 40 percent.

28. The gear lubricant of claim 27, wherein the base oil is a bottoms product of a vacuum distillation.

29. The gear lubricant of claim 27, wherein the base oil has a T10 boiling point by ASTM D 6352 greater than 538° C. (1000° F.).

30. The gear lubricant of claim 27, wherein the traction coefficient is less than 0.012.

31. The gear lubricant of claim 30, wherein the traction coefficient is less than 0.010.

32. The gear lubricant of claim 27, wherein the base oil has a VI greater than 160.

33. A finished lubricant, comprising;

a. a Fischer-Tropsch derived base oil having a traction coefficient less than 0.015 when measured at 15 cSt and at a slide to roll ratio of 40 percent; and b. an effective amount of one or more lubricant additives.

34. The finished lubricant of claim 33, wherein the Fischer-Tropsch derived base oil has a 50 weight percent boiling point by ASTM D 6352 greater than 566° C. (1050° F.).

35. The finished lubricant of claim 33, wherein the Fischer-Tropsch derived base oil has a branching index by $^{1}H$ NMR less than 23.4 and a branching proximity by $^{13}C$ NMR greater than 22.

36. The finished lubricant of claim 33, wherein the finished lubricant is a gear lubricant.

37. The finished lubricant of claim 36, wherein the gear lubricant is a wormgear lubricant or an EP gear lubricant.

38. The finished lubricant of claim 33, additionally comprising one or more other base oils selected from the group of Group I, Group II, petroleum derived Group III, polyalphaolefin, ester, polyglycol, polyisobutene, and alkylated naphthalene.

39. A lubricant base oil, comprising a. a traction coefficient less than 0.011; and b. a 50 weight percent boiling point by ASTM D 6352 greater than 582° C. (1080° F.).

40. The lubricant base oil of claim 39, additionally comprising a branching index by $^{1}H$ NMR less than 23.4 and a branching proximity by $^{13}C$ NMR greater than 22.

41. The lubricant base oil of claim 39, additionally comprising an Oxidator BN greater than 12 hours.

42. The lubricant base oil of claim 39, additionally comprising a pour point greater than −15° C.

43. The lubricant base oil of claim 39, additionally comprising a ratio of pour point, in degrees C., to the kinematic viscosity at 100 degrees C., in cSt, greater than a Base Oil Pour Factor, where the Base Oil Pour Factor is defined by the equation:

$$\text{Base Oil Pour Factor} = 7.35 \times \text{Ln}(\text{Kinematic Viscosity at } 100^\circ\text{ C.}) - 18.$$

44. The lubricant base oil of claim 39, additionally comprising greater than 4 wt % naphthenic carbon by ASTM D 3238.

45. The lubricant base oil of claim 44, comprising greater than 5 wt % naphthenic carbon.

46. The lubricant base oil of claim 39, additionally comprising a Free Carbon Index between 9 and 30.

* * * * *